US010086622B2

(12) United States Patent
Essien et al.

(10) Patent No.: US 10,086,622 B2
(45) Date of Patent: Oct. 2, 2018

(54) APPARATUSES AND METHODS FOR STABLE AEROSOL-BASED PRINTING USING AN INTERNAL PNEUMATIC SHUTTER

(71) Applicants: Marcelino Essien, Cedar Crest, NM (US); David Michael Keicher, Albuquerque, NM (US)

(72) Inventors: Marcelino Essien, Cedar Crest, NM (US); David Michael Keicher, Albuquerque, NM (US)

(73) Assignee: Integrated Deposition Solutions, Inc., Albuquerque, NM (US)

( * ) Notice: Subject to any disclaimer, the term of this patent is extended or adjusted under 35 U.S.C. 154(b) by 0 days.

(21) Appl. No.: 15/619,503

(22) Filed: Jun. 11, 2017

(65) Prior Publication Data

US 2018/0015730 A1 Jan. 18, 2018

Related U.S. Application Data

(60) Provisional application No. 62/362,583, filed on Jul. 14, 2016.

(51) Int. Cl.
*B41J 2/175* (2006.01)
*B41J 2/07* (2006.01)

(52) U.S. Cl.
CPC ..... *B41J 2/17596* (2013.01)

(58) Field of Classification Search
CPC ..... B41J 2/17596; B41J 29/38; B41J 2/07; H01L 21/8234
See application file for complete search history.

(56) References Cited

U.S. PATENT DOCUMENTS 7,674,671 B2 * 3/2010 Renn ..... H01C 17/06 438/238

* cited by examiner

*Primary Examiner* — Thinh H Nguyen

(57) ABSTRACT

The object of the invention is the provision of apparatuses and methods for stable direct printing of continuous films or discreet structures on a substrate using an internal pneumatic shutter. The invention uses an aerodynamic focusing technique, with a print head comprising an aerosolization source, a flow cell, an aerodynamic lens system, and a pneumatic shutter assembly. The method uses an interchangeable and variable aerodynamic lens system mounted in the flow cell, and an annularly flowing sheath gas to produce a highly collimated micrometer-size stream of aerosolized droplets. The lens system is comprised of a single-orifice or multi-orifice lens coupled to a converging fluid dispense nozzle. A liquid atomizer with temperature control is used to produce an aerosol size distribution that overlaps the functional range of the aerodynamic lens system. The shutter assembly can be attached directly to the print head, or mounted external to the print head in a control module. The preferred embodiment of the invention contains no moving parts internal to the print head, and provides non-contact shuttering of an aerosol stream. Internal shuttering of the aerosol stream is accomplished using co-propagating compressed gas and vacuum flows, a single vacuum exhaust flow, or by redirecting an aerosol carrier gas from the input port of an aerosol chamber to a continuously propagating sheath gas flow. The apparatus uses no external parts to collect or redirect the aerosol stream outside the print head. The internal shutter design allows for a reduced printer working distance, so that a substrate may be placed at the focal point of small aerosol droplets focused near the print head exit nozzle. The method produces well-defined traces on a substrate with line widths in a range from approximately 10 to 1000 microns, with sub-micron edge definition and shuttering times as small as 10 milliseconds.

12 Claims, 4 Drawing Sheets

Figure 1:
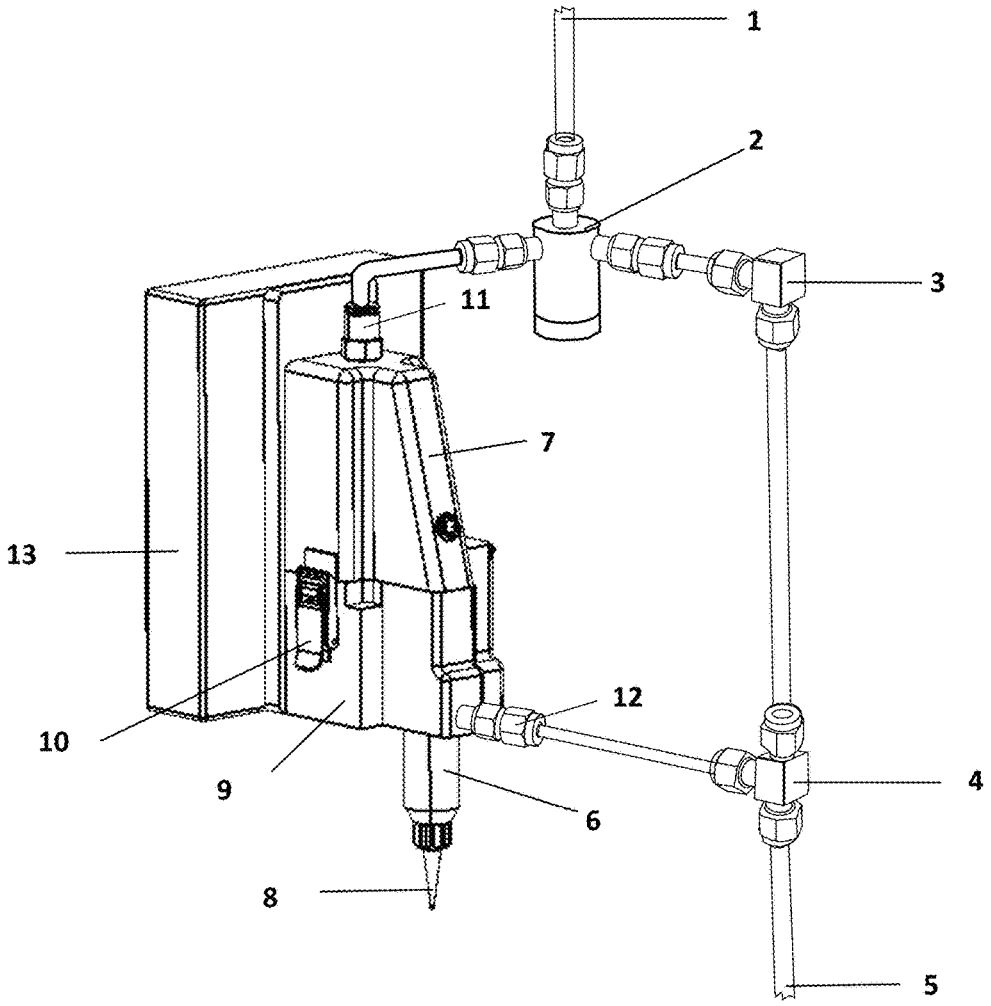

APPARATUSES AND METHODS FOR STABLE AEROSOL-BASED PRINTING USING AN INTERNAL PNEUMATIC SHUTTER

CONTENTS

RELATED U.S. APPLICATION DATA
REFERENCES CITED
U.S. Patents
Other Publications
FIELD OF THE INVENTION
BACKGROUND OF THE INVENTION
General Discussion of Aerosol-Based Printing
Aerodynamic Focusing Using an Aerodynamic Lens
Aerodynamic Focusing for Direct Printing Applications
Internal Pneumatic Shuttering of an Aerosol Stream
DESCRIPTION OF THE PRIOR ART
Aerodynamic Focusing Using a Sheath Gas
Particle Collimation in a Gas Flow
Aerodynamic Focusing Using an Aerodynamic Lens System
Multi-Stage Lens System
SUMMARY OF THE INVENTION
A Brief Description of the Drawings
A Detailed Description of the Preferred Embodiments
Introduction
General Description of the Device
Single-Stage Lens System
Apparatus and Process Parameters
Multi-Stage Lens System
General Description of Internal Shuttering
Pneumatic Shuttering at Low Gas Flow Rates
Description of the Preferred Embodiment
Pneumatic Shuttering and Maintenance of Constant Pressure
Reduced Working Distance and Improved Print Quality
Increased Ink Usage
Extended Sheath Flow
Multi-Nozzle Microjet Arrays
Laser-Assisted Microjet Deposition
Direct Printing of UV Curable Inks
Direct Printing of Films and Discreet Structures
3D Printing
3-D Structures for Medical Applications
CLAIMS

RELATED U.S. APPLICATION DATA

No related U.S. applications

REFERENCES CITED

U.S. Patents

Brockmann, J. E., et. al., Aerodynamic Beam Generator for Large Particles. U.S. Pat. No. 6,348,687, Feb. 19, 2002.
Hochberg, F., et. al. Micromist Jet Printer. U.S. Pat. No. 4,019,188, Apr. 19, 1977.
Lee, D., Lee, K., Aerodynamic Lens Capable of Focusing Nanoparticles in a Wide Range, U.S. Pat. No. 8,119,977 B2, Feb. 21, 2012.
Lee, D., and Lee, K., Aerodynamic Lens, U.S. Pat. No. 7,652,247 B2, Jan. 26, 2010.

Rao, N. P., et. al., Apparatus and Method for Synthesizing Films and Coatings by Focused Particle Beam Deposition, U.S. Pat. No. 6,924,004 B2, Aug. 2, 2005.
Novosselov, et. al., Particle interrogation devices and methods, U.S. Pat. No. 8,561,486, Oct. 22, 2013.

Other Publications

De la Mora. (1988). Aerodynamic Focusing of Particles in a Carrier Gas. *J. Fluid Mech.,* 195, 1-21.
Cheng and Dahneke. (1979). Properties of Continuum Source Particle Beams. II. Beams Generated in Capillary Expansions. *J. Aerosol Sci.,* 10, 363-368.
Dahneke. (1977). Nozzle-Inlet Design For Aerosol Beam Instruments. In J. J. Potter, *Rarefied Gas Dynamics*, Vol. II (pp. 1163-1172). New York: AIAA.
Dahneke. (1978). Aerosol Beams. In D. T. Shaw, *Recent Developments in Aerosol Science* (pp. 187-223). New York: John Wiley & Sons.
Dahneke. (1979). Properties of Continuum Source Particle Beams. I. Calculation Methods and Results. *J. Aerosol Sci.,* 10, 257-274.
Deng, R. (2008). Focusing Particles with Diameters of 1 to 10 Microns into Beams at Atmospheric Pressure. *Aerosol Science and Technology,* 42:11, 899-915.
Mallina. (1999). High-Speed Particle Beam Generation: Simple Focusing Mechanisms. *J. Aerosol Sci.,* 30, 719-738.
Mallina. (2000). High Speed Particle Beam Generation: a Dynamic Focusing Mechanism for Selecting Ultrafine Particles. *Aerosol Sci. Technol.,* 33, 87-104.

FIELD OF THE INVENTION

Embodiments of the invention generally relate to devices used to shutter a continuous particle stream, particularly devices for direct printing of discreet features on a surface.

BACKGROUND OF THE INVENTION

General Discussion of Aerosol-Based Printing

Direct Write printing, defined as maskless printing of discreet structures on a substrate in a one-step process offers many advantages to conventional printing technologies such as lithography and chemical and physical vapor deposition. Indeed, Direct Write processes such as aerosol-based printing are far less expensive to establish and maintain, and offer greater flexibility than conventional techniques. Embodiments of the present invention offer methods and apparatuses for aerosol-based direct printing of discreet structures using a multi-lens aerodynamic focusing assembly and a material shuttering assembly that produces shuttering of an aerosol stream within a print head. The apparatus of the invention produces discreet structures by shuttering a continuous stream of aerosol particles using a pneumatic shutter. In the most common embodiment, the Direct Write apparatus is comprised of a print module, a process vision module, a part alignment module, a shutter assembly, and a motion control module. The print module consists of an aerosolization source, a pressure and vacuum source, a cold plate, and a print head. The process vision module provides real-time viewing of the deposition process. The alignment module is used to define the vector distance between the axis of an alignment camera and one or more print heads, and for substrate alignment. The motion control module provides computer-controlled multi-axis motion of the substrate, and coordinated shuttering of the aerosol stream. The invention is capable of printing features as small as approximately 10 microns, at shuttering speeds as fast as approximately 10 milliseconds.

Aerodynamic Focusing Using an Aerodynamic Lens

The use of aerodynamic lenses to focus an aerosol stream was first reported by Lui. An aerodynamic lens can be defined as a flow configuration in which a stream traveling through a cylindrical channel with diameter D is passed through an orifice with diameter d, undergoing one contraction upstream of the orifice and one subsequent and immediate expansion downstream of the orifice. A contraction of an aerosol stream is produced as the flow approaches and passes through the orifice. The gas then undergoes an expansion as the flow propagates downstream into a wider cross sectional area. Flow through the orifice forces particles towards the flow axis, so that the aerosol stream is narrowed and collimated. Aerosol streams collimated by an aerodynamic lens system have been designed for use in many fields, including pharmaceutical aerosol delivery and additive manufacturing. In the typical aerodynamic lens system, an aerosol stream is tightly confined around the axis of a flow cell by passing the particle distribution through a series of axisymmetric contractions and expansions. Each section of the lens system consisting of a flow channel and an orifice is defined as a stage. Lui has presented a method and apparatus for focusing sub-micron particles using an aerodynamic lens system. Di Fonzo et. al. and Dong et. al. have designed lens systems that focused particles with diameters in the range from 10 to 100 nanometers and 10 to 200 nanometers, respectively. Wang has designed a lens system to focus particles in the range of 3 to 30 nanometers. Lee has reported a method of focusing micron-sized particles at atmospheric pressures using a single lens system composed of multiple stages.

In U.S. Pat. No. 6,348,687, Brockmann discloses an apparatus for generating a collimated aerosol beam of particles with diameters from 1 to 100 microns. The aerodynamic lens system of Brockmann uses a series of fixed lens and an annular sheath gas surrounding a particle-laden carrier gas. The system of Brockmann was used to focus 15-micron aluminum particles to a diameter of 800 microns, and generally uses the same aerosol and sheath gas flow rates. Lee (U.S. Pat. No. 7,652,247) discloses an aerodynamic lens system for focusing nanoparticles in air with diameters between 5 and 50 nanometers. In U.S. Pat. No. 8,119,977, Lee discloses a multi-stage, multi-orifice aerodynamic lens for focusing a range of particle diameters covering two orders of magnitude, from 30 to 3000 nanometers. In U.S. Pat. No. 6,924,004, Rao discloses a method and apparatus for depositing films and coatings from a nanoparticle stream focused using an aerodynamic lens system. The apparatus of Rao uses high-speed impaction to deposit nanoparticles on a substrate. A method of separating particles from a gas flow using successive expansions and compressions of the flow created by an aerodynamic lens is discussed by Novosselov in U.S. Pat. No. 8,561,486.

Aerodynamic Focusing for Direct Printing Applications

The general embodiment of the invention uses a method for stable direct printing of discreet structures on a substrate using aerodynamic focusing and pneumatic shuttering to produce highly collimated beams of sub-micron and micron-size droplets using an aerodynamic lens system, an annular sheath flow closely matched to the output of an aerosol source, and a combination compression and vacuum shuttering flow propagating perpendicular to the combined aerosol/sheath flow. In the preferred embodiment of the invention, the aerosolization source is a low-power ultrasonic atomizer operating in a continuous or pulsed mode. The atomizer described herein produces a relatively narrow range of droplet diameters, from approximately 0.5 to 5 microns, facilitating the production of a narrow, collimated aerosol beam. The atomizer power is typically less than approximately 10 watts. The lens system may consist of a single stage or multiple stages. The present invention is used to deposit well-defined traces onto various substrates with sub-micron edge definition. The apparatus uses interchangeable and variable aerodynamic lenses with configurations that can be tuned to match the aerosol output of the aerosol generator, so that a high degree of collimation of the aerosol beam is obtained.

In a Direct Printing technique, an ink is deposited onto a substrate without the use of masks or lithographic techniques. The present invention uses an aerodynamic lens system to form a thin aerosol jet surrounded by a sheath gas. The diameter of the core aerosol distribution is a function of the lens parameters such as channel length, lens orifice diameter, and the length of the lens. In the print mode, the apparatus propagates a combined sheath gas flow and an aerosol carrier gas flow through an aerodynamic lens system. The lens system is commonly terminated by a converging fluid dispense nozzle with an exit orifice positioned over a substrate. The distance between the exit orifice and the substrate is referred to as the working distance.

Internal Pneumatic Shuttering of an Aerosol Stream

The present invention provides methods and apparatuses for internal, contact or non-contact shuttering of an aerosol stream for the purpose of printing discreet structures on a surface. The invention discloses an apparatus for fast shuttering of an aerosol stream or a sheathed aerosol stream. Embodiments of the invention can be applied to, but not limited to processes requiring coordinated shuttering of a stream of particles, such as aerosol-based printing of discreet structures for Direct Write Electronics, for aerosol delivery applications, or for various 3D Printing applications. The aerosol stream may be composed of solid particles or liquid droplets.

A critical characteristic of the invention is that shuttering of the aerosol stream is accomplished without the use of wetted or impacted parts that come into contact with the particle stream after the particles exit the print head. Interrupting the particle stream on the exterior of the print head can lead to defocusing of the stream, particle scattering, material buildup on the shuttering mechanism, and unintended deposition of material during shuttering. The present invention overcomes issues associated with external mechanical or external pneumatic shuttering.

Shuttering time is defined as the time delay between initiation of a shutter signal (normally a low-voltage TTL pulse) and the enabling or disabling of stable aerosol delivery. Shuttering times of the invention are limited by the inherent delay associated with the actuation of electromechanical components of the shutter valve system. Shuttering times can be as small as 10 milliseconds.

Inhibiting Aerosol Flow within the Print Head

In one embodiment, the invention uses a single solenoid valve or multiple solenoid valves exterior to the print head to divert the aerosol stream from the internal print head flow axis and through a vacuum exhaust port. In another embodiment, a single valve or multiple valve system is used to interrupt the flow of aerosol carrier gas to the aerosol chamber. The valve system adds the diverted gas flow to the sheath gas flow. By diverting the aerosol gas flow and simultaneously adding the aerosol gas flow to the sheath gas flow, the pressure within the print head remains constant, while flow of aerosol from the aerosol chamber is stopped. The shuttering process is therefore internal to the print head, that is, no impaction or diversion of the aerosol stream occurs exterior to the print head. In the preferred embodiment, no internal moving parts or aerosol/shutter impact surfaces are used. In another configuration, the apparatus uses combined co-propagating compression and vacuum flows to shutter the aerosol stream. In the preferred embodiment of the invention, a single three-way universal solenoid valve is used to direct the aerosol gas flow to the aerosol chamber during printing. During shuttering, the aerosol gas is diverted and combined with the sheath gas, so that aerosol flow from the aerosol chamber is inhibited, and shuttering of the particle stream is accomplished.

Decrease Working Distance

The internal aspect of the shutter allows for a decreased working distance and precise deposition of aerosol droplets with a size distribution as wide as 2 to 4 microns. While the multi-lens configuration of the invention allows for working distances as great as 20 mm, the working distance can be less than 1 mm, allowing for focusing of small droplets in the aerosolized particle distribution. The non-impact aspect of the shutter eliminates accumulation of droplets on shutter components, allowing for extended unassisted operating times. The use of an internal, non-impact shutter allows for unassisted printing of discreet features with repetitive shuttering for a minimum of eight hours.

DESCRIPTION OF THE PRIOR ART

Aerodynamic Focusing Using a Sheath Gas

Aerodynamic focusing using a sheath gas is generally accomplished by propagating an annular sheath/aerosol flow through a continuously converging nozzle, using differing sheath and aerosol gas flow rates. The degree of focusing is proportional to the ratio of the gas flows. In U.S. Pat. No. 7,108,894B2, Renn discloses a method of aerodynamic focusing using a coaxial sheath gas flow that surrounds an aerosol-laden carrier gas. The combined flow is then propagated through a converging nozzle. Renn teaches that for the operational range of a flow system using a sheathed aerosol stream and a single converging nozzle, the diameter of the focused beam is a strong function of the ratio of the sheath to aerosol gas flow rates. Shuttering of the aerosol stream is accomplished using an external pneumatic shutter.

Particle Collimation in a Gas Flow

Hochberg (1977) has described an apparatus for deposition of a collimated stream of aerosolized particles. The velocity of the aerosol carrier gas flow through a rectangular channel is chosen so that the particles are forced towards the center of the gas flow. A sheath flow upstream of an exit nozzle prevents impaction of particles onto the nozzle.

Aerodynamic Focusing Using an Aerodynamic Lens System

Focusing of a stream of aerosol particles using a system of aerodynamic lenses was first reported by Lui in 1995. The system of Lui was used to narrow and collimate a beam of spherical particles with diameters of approximately 25 to 250 nanometers. Lui used a lens system having three to five stages, with emphasis placed on achieving a low pressure drop across each lens. Numerous experimental and theoretical studies have been performed subsequent to the work of Lui, considering the aerodynamic effects of single and multi-orifice lens configurations.

Multi-Stage Lens System

Many researchers have reported studies of aerodynamic focusing of aerosol streams using fixed multi-stage lens systems (Lee, Brockmann, and Lui). Lee discloses an aerodynamic lens for focusing nanoparticles with diameters ranging from 30 to 3000 nanometers. Brockmann describes a multi-stage lens system that focuses large, solid particles. The Brockmann apparatus also uses an annularly flowing sheath gas to prevent impaction of particles onto the orifice surfaces. The apparatus of Brockmann propagates a sheath gas flow through the entire multi-stage lens system. Lui has disclosed an apparatus for focusing nanoparticles using an aerodynamic system consisting of three to five stages.

The preferred embodiment of the present invention uses a tunable atomizer, an interchangeable and adjustable single-stage or multi-stage aerodynamic lens, and an annularly flowing sheath gas to collimate and deposit a stream of particles with diameters in the range of approximately 0.8 to 5 microns. The general embodiment of the invention uses ultrasonic atomization to produce an aerosol distribution, however other atomization techniques can be used to produce droplet diameter distributions similar to that produced using ultrasonic aerosolization.

SUMMARY OF THE INVENTION

A Brief Description of the Drawings

FIG. 1. A drawing of the print head and internal pneumatic shuttering scheme.

Figure 2:
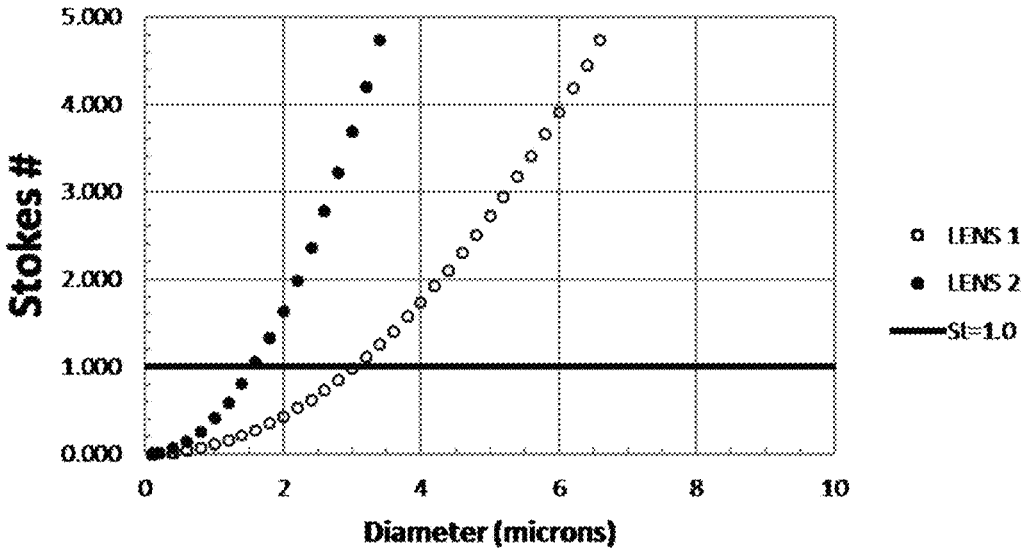

FIG. 2. A plot of the Stokes number of a droplet distribution passing through two aerodynamic lenses.

Figure 3:
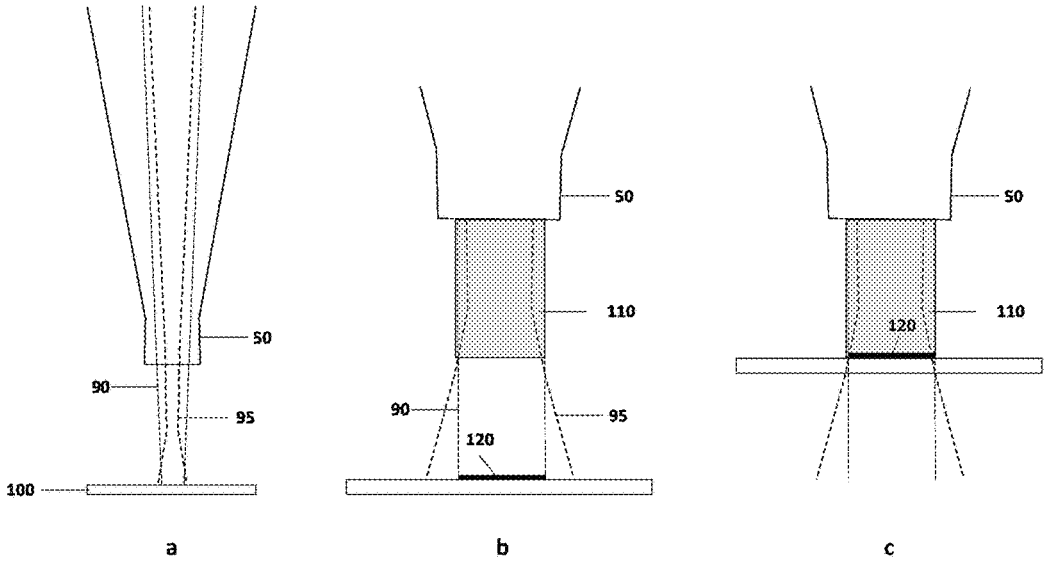

FIG. 3. A schematic representation of focusing of a droplet distribution by an aerodynamic lens assembly and the importance of working distance.

Figure 4:
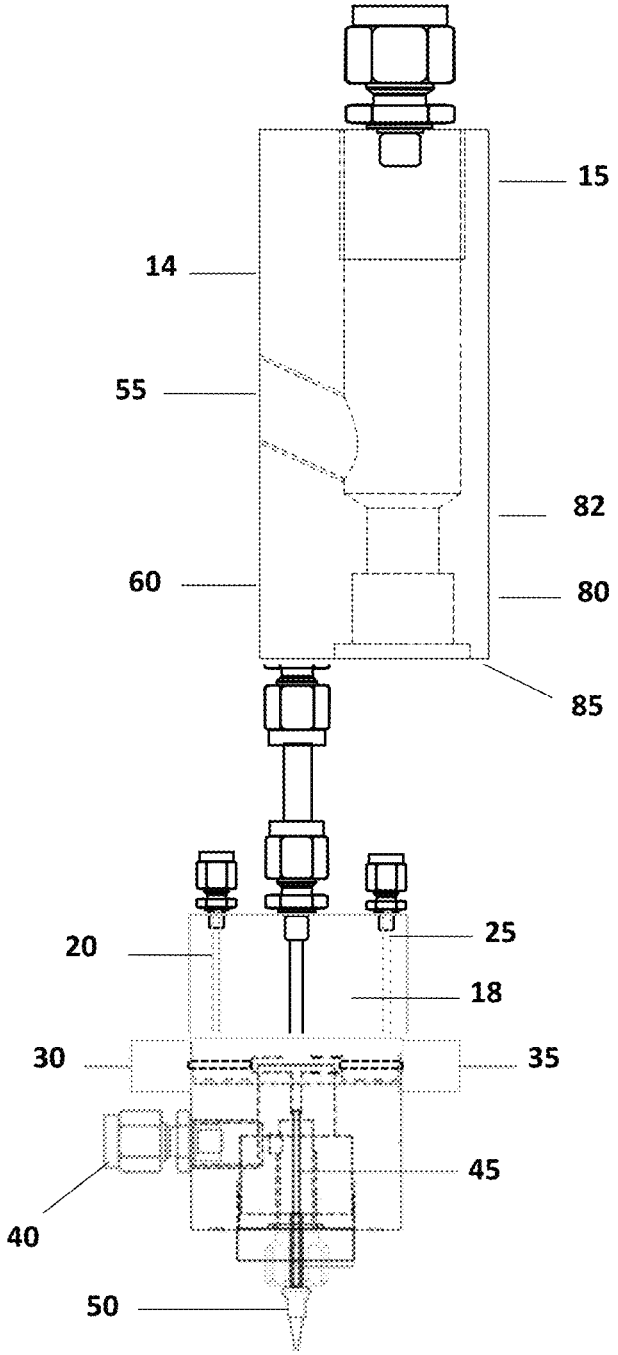

FIG. 4. A drawing of an alternate atomizer and flow cell configuration.

A Detailed Description of the Preferred Embodiments

Introduction

The invention provides for a method and apparatus for direct printing of discreet microscopic to macroscopic features on a substrate in ambient conditions. Of particular interest is the provision of a process and apparatus for stable and repeatable deposition of liquids onto substrates for additive manufacturing applications, including but not limited to metallization of rigid and flexible substrates, deposition of inorganic and organic samples for sensor applications, and deposition of various inks for green energy applications such as solar cell metallization and fuel cell production.

General Description of the Device

The preferred embodiment of the invention is shown in FIG. 1. The print head consists of an atomizer, an interchangeable ink cartridge, a flow cell, a cold plate, and a shuttering assembly. An ink sample is contained in a vial attached to the ink cartridge 7. The vial is held above a coupling fluid that transfers ultrasonic energy to the ink from an ultrasonic transducer. The ultrasonic atomizer assembly 9 produces a poly-dispersed distribution of ink droplet diameters over a range of several microns. The ink cartridge 7 is attached to the atomizer assembly 9 using clamps 10 on either side of the assembly. An aerosol carrier gas enters the system through conduit 1. In the print mode a three-way valve 2 directs the carrier gas to the atomizer chamber of the ink cartridge 7 through input port 11. In a shuttered mode, a signal to valve 2 closes the valve port in communication with the aerosol input port 11, and redirects the aerosol gas flow through a valve port in communication with an elbow 3 and a tee 4. The diverted gas is combined with a continuously flowing sheath gas that enters the print head through conduit 5. The flow cell 6 consists of a flow channel and an aerodynamic lens system that form an annular flow consisting of an inner aerosol-laden stream and an outer sheath gas flow. A cold plate 13 cools the atomizer drive circuit, the ink, and the print module. Reduction of the diameter of an aerosol beam introduced into the flow cell is accomplished through the combined effect of the sheath gas and the lens system. The aerosol-laden carrier gas stream is narrowed as it passes through at least one contraction and subsequent expansion within the flow cell. The lens system is tuned to the mean diameter of the aerosol distribution, so that a particle stream with a diameter that is a fraction of the lens orifice diameter is formed when the stream is passed through a converging nozzle. The converging nozzle 8 is typically a fluid dispense tip, with an exit orifice diameter ranging from 50 to 500 microns. The sheath gas flow is primarily used to prevent impaction of the droplets onto the surfaces of the lens and to focus small particles as the stream is passed through the converging nozzle. Shuttering of the aerosol stream is accomplished by diverting the aerosol gas flow and simultaneously adding the aerosol gas flow to the sheath gas flow.

Single-Stage Lens System

The parameters of the present invention are adjusted to match the distribution of an aerosol source and the working range of the aerodynamic lens. In one embodiment of the invention, the sheath gas flow is combined with the output of a single-stage lens, and the combined annular flow is directed through an exit orifice. A stage is defined as an aerodynamic lens configuration that produces one contraction and expansion of the gas stream. The gas stream may be an aerosol-laden stream, or a sheathed aerosol-laden stream. In another embodiment, the sheath flow is combined with the aerosol stream to form an annular flow before the flow enters the lens. The combined flows are directed through an exit orifice. The parameters of the aerosol source can also be adjusted to approximately match the peak of the aerosol distribution to the functional range of the lens system. The Reynolds number of the sheath flow through the exit orifice is adjusted so that the smaller droplets in the aerosol distribution are collimated by the sheath gas, producing a narrow, collimated beam. The aerosol beam remains collimated up to approximately one centimeter beyond an exit orifice, and produces high-resolution traces with little or no extraneous deposition in the form of droplets deposited beyond the borders of the trace. Deposited trace line widths are in the range of approximately 10 to 1000 microns.

The internal shutter of the invention may be used in single and multi-stage configurations, and in both cases allows for rapid shuttering, extending operating times, and improved print quality.

Apparatus and Process Parameters

In the preferred embodiment of the invention, the output of the atomizer is matched to the functional range of the aerodynamic lens system. The atomizer output is typically poly-dispersed, consisting of a distribution of droplet diameters in the range of approximately 0.5 to 5 microns. In general, an aerodynamic lens is defined as a flow device that produces at least one contraction and expansion of a gas stream or a stream of aerosol-laden gas before entering an exit nozzle. An aerodynamic lens is formed from a channel with a distinct and abrupt reduction in cross sectional area formed by an orifice generally located at the downstream end of the channel. The functional range of the aerodynamic lens system depends on the aerodynamic and device parameters such as channel length and width, orifice diameter, and the number of lenses. The apparatus of the invention is typically tuned so that the mean size in the droplet distribution of the atomizer is narrowed and collimated by the lens system. Droplets with diameters approximately one to two microns plus or minus the mean diameter are also focused by the lens system. An annularly flowing sheath gas is used to force small droplets in the distribution into a diameter that is less than or approximately equal to the diameter into which larger droplets are collimated. In the general embodiment, the sheath flow is used to narrow the small droplet trajectories and to collimate droplets in the lower end of the distribution, while the lens system is used to collimate larger droplets with diameters near the mean diameter of the distribution.

Multi-Stage Lens System

The preferred embodiment of the invention is designed to focus a droplet distribution centered about a diameter of approximately 3 microns. Focusing of an aerosol stream by an orifice is dependent on the particle Stokes number, S. De la Mora teaches that in a cylindrically symmetric configuration, particles will cross the flow axis at a common focal point if S if greater than a critical value S*. It has been shown that a threshold value for focusing is obtained when S*~1. De la Mora also teaches that the focused spot diameter may be as much as 100 times smaller than the orifice diameter if the region over which particles are seeded is restricted. Restriction of the particle trajectories entering the orifice is accomplished in the present invention by using an aerodynamic lens upstream of the exit nozzle.

The Stokes number is related to the particle diameter and the orifice diameter according to the equation;

$$St = \left(\frac{\rho d^2 C}{18\mu}\right)\frac{U}{D}$$

where ρ is the particle density, d the particle diameter, C the slip correction factor, μ the gas dynamic viscosity, U the gas velocity at the orifice, and D the orifice diameter. The slip correction factor is calculated to be approximately 1. A plot of St versus the particle diameter for the parameters of a common configuration of the invention is given in FIG. 2. The plot shows the approximate Stokes numbers for a distribution of particles passing through two orifices of a lens assembly under the influence of a sheath gas flow. Due to the presence of the first lens upstream of the nozzle, large particles (particles with diameter near approximately 3 microns) are forced towards the center of the aerosol stream, while smaller particles are strongly coupled to the aerosol gas flow. The sheath flow through the exit nozzle (lens 2) will focus small particles (between approximately 0.8 and 1.5 microns), but have little or no effect on medium to large-size particles collimated by the first lens. From the plot of FIG. 2, it is seen that small particles passing through lens 2 will have St<1, and will be closely coupled to the gas streamlines. As a result, small droplets passing through lens 2 will come to a minimum focus closer to the orifice than larger droplets, and will also diverge more rapidly than large droplets. For a distribution of droplet diameters, it is therefore critical that the working distance of the system is small enough to allow for placement of the substrate within the focal distance of the small droplets, FIG. 3*c*.

General Description of Internal Shuttering

Pneumatic Shuttering at Low Gas Flow Rates

The present invention provides methods and apparatuses for shuttering of the aerosol stream. Interruption of the aerosol stream to the substrate surface must be accomplished for printing of discreet structures without the use of masks or stencils. In the preferred embodiment, shuttering is accomplished by diverting the aerosol flow to a collection filter using vacuum and pressure-based actuation. The print head and shuttering assembly are designed to produce trace line widths as small as 10 microns. Pneumatic shuttering of systems that use relatively high gas flow rates (total gas flow rates greater than approximately 50 ccm) rely on the large flow of gas to re-pressurize the system's flow cell after a shuttering event. With the present apparatus, line widths of less than approximately 50 microns require aerosol carrier gas flow rates of less than 10 cc/min (10 ccm). The internal shutter must consequently provide fast, stable operation at gauge pressures well below 1 psi, and in some cases, the shutter must function at pressures less than approximately 0.2 psi. Pneumatic shuttering schemes are typically based on diverting a particle stream to an exhaust port using a compressive gas flow, a vacuum gas flow, or both compressive and vacuum flows. Maintenance of the flow cell's operating pressure, or at least fast re-pressurization of the flow cell after shuttering is critical for fast operation of the shutter.

The present invention uses a vacuum flow to quickly and efficiently pull the aerosol stream from the flow cell, and a compressive flow to maintain the flow cell pressure. The action of the vacuum flow diverts the aerosol stream from the flow axis, causing the flow cell pressure to drop. Since stable aerosol flow through the orifice (printing) is not re-established until the flow cell pressure reaches a critical value, the speed of the shuttering assembly is related to the time $t_c$ required for the flow cell pressure to rise to some critical value. In order to achieve a minimum $t_c$, a compression flow is used to maintain the net flow of gas through the flow cell during shuttering. Maintenance of the flow cell pressure during shuttering allows for shuttering times as small as 10 milliseconds.

In the preferred embodiment, the invention diverts the aerosol carrier gas flow from the aerosol chamber to the sheath gas flow. Since the combined flow exiting the flow cell is maintained, the pressure within the print head during shuttering is equal to the pressure during printing. The shuttering time is therefore largely determined by the electromechanical delay of a solenoid valve, amounting to no more than an approximate 10 milliseconds delay in shuttering of the aerosol stream.

A Detailed Description of the Preferred Embodiment

Pneumatic Shuttering and Maintenance of Constant Pressure

The preferred embodiment of the invention accomplishes shuttering by diverting an aerosol carrier gas flow from the print head aerosol input port and adding the diverted flow to the sheath gas flow. The carrier gas flow is reintroduced into the print head through the sheath gas input port, so that a constant pressure is maintained within the print head. A delay in the actuation of the on or off state of the device will occur during shuttering if the internal pressure of the print head is reduced, while an increased deposition rate will occur if the internal pressure increases. For fast shuttering, it is therefore critical that the pressure within the print head during shuttering remains the same as the pressure during printing. Reintroduction of the aerosol gas into the print head ensures maintenance of constant pressure during shuttering, and ensures that the pressure during shuttering is equal to the pressure during printing. If a single aerosol-laden flow is used, the gas can be reintroduced to the print head downstream of an internal aerosol input conduit, and upstream of the final focusing orifice. If a sheath flow is used, the aerosol gas is added to the sheath gas flow during shuttering, so that in either case, a constant internal pressure is maintained within the print head.

Reduced Working Distance and Improved Print Quality

Aerosol shuttering schemes that use external shuttering typically position a shutter blade or shuttering assembly between the exit nozzle and the substrate. External shuttering schemes therefore inherently increase the printer working distance. Since print quality is inversely related to the working distance, external shuttering schemes can have inherent issues associated with a poorly-focused aerosol stream. The present invention uses no shuttering components mounted external to the print head and between the aerosol stream exit nozzle and the substrate, so that printing with working distances as small 1 mm is enabled.

Modified Droplet Diameter Distribution

In the general embodiment of the invention, an ultrasonic transducer frequency of 1.6 MHz is used to produce an atomized droplet distribution with droplet diameters from approximately 0.5 to 4 microns. In another embodiment, the ultrasonic transducer frequency is shifted to between approximately 1.0 MHz to 1.4 MHz, so that the lower end of the droplet distribution is shifted to approximately 0.7 to 1.0 microns. The shift to a larger droplet distribution enables increased high-definition printing, with trace edge definition in the sub-micron range.

Increased Ink Usage

The apparatus of the invention provides for shuttering of an aerosol stream with virtually no wasted material. In the preferred embodiment of the invention, flow of the aerosol stream is stopped during shuttering, so that material dispensing from the print head is disabled during shuttering. Since a constant pressure is maintained within the print head, jetting of the particle stream is restarted within less than approximately 50 milliseconds after a shuttering valve is closed.

The internal aspect of the pneumatic shutter of the present invention allows for a reduced printing distance between the exit orifice and the substrate. Consequent to a decreased working distance, precise droplet deposition is achieved, with no deposition outside the primary focal diameter. Since the invention has no shuttering components that are external to the exit orifice (excluding miniature valves), the printer working distance can be as small as several hundred microns. The reduced working distance offered by the internal pneumatic shutter allows for the production of precise ink deposition, with minimal extraneous aerosol deposition. All single or multi-lens aerodynamic focusing systems will focus droplets of different sizes at different points along the print head flow axis. The use of multiple aerodynamic lenses reduces the difference in the focal distance of droplets at either side of a droplet size distribution; however, for relatively expansive distributions (with droplets sizes spanning a range of approximately 3 to 6 microns) focusing of different droplet diameters at different focal points can cause imprecise, poor-quality deposition, characterized by scattered deposition of large and small particles.

The internal shutter of the invention also allows printing on surfaces near features protruding from a substrate that would otherwise be blocked by an external shutter assembly.

The advantages of an internal shutter can be seen in FIG. 3. FIG. 3*a* shows the envelop of large droplets 90 and the envelop of small droplets 95 focused by the lens system and emerging from the exit nozzle 50. For droplet size distributions commonly produced using electronic printing inks and ultrasonic atomization, the small droplets in the distribution (diameters between approximately 0.5 and 1 micron) are typically focused approximately 1 to 3 millimeters from the exit orifice. For a printing apparatus with a droplet distribution that is poorly-coupled to the aerodynamic system, the smaller droplets can come to focus at less than one millimeter from the exit orifice. FIG. 3*b* shows the region where the two envelops intersect 110. If a substrate 100 is placed beyond the region 110, a scattering of small droplets (overspray) will be deposited onto the substrate outside the primary deposition zone 120. Contrastingly, if a substrate is placed at a distance from the nozzle within the region 110, optimum print quality will be obtained, with minimal or no extraneous deposition, FIG. 3*c*. Aerosol printing systems with external shutter assemblies will therefore be prone to non-optimum printing, characterized by overspray deposition and poor edge definition.

In yet another embodiment, the atomizer and flow cell are two distinct units connected by an aerosol conduit, FIG. 4. The apparatus consists of a separate atomizer 14 and flow cell 18, and a shuttering assembly (20 through 35). As in the general embodiment, the ultrasonic atomizer consists of a planar piezoelectric transducer 85 with indirect contact with the ink sample. Ultrasonic energy is transferred from the transducer to the ink through a coupling fluid held in a coupling chamber 80. Ink is contained in an ink chamber 82. An atomizer power supply produces a continuous or pulsed excitation at the transducer resonant frequency. An inert carrier gas enters the atomizer through input port 15. A baffle (not shown) and an angled aerosol exit channel 55 prevent entrainment of fluid and large droplets into the aerosol delivery channel 60. The focused aerosol stream exits the apparatus from the converging nozzle 50. The configuration of FIG. 4 allows for the use of interchangeable, reusable ink cartridges mounted directly above the transducer/coupling chamber assembly. Shuttering of the aerosol stream is accomplished by propagating a compression flow along a vertical channel 20, through solenoid valve 30, across the flow channel 60, through solenoid valve 35, and along vertical channel 25.

In still another embodiment, a shuttering component such as an internal plunger or flap is used to block flow of the aerosol stream into the flow cell of the print head while the aerosol gas flow is diverted and combined with the sheath gas flow using a valve assembly mounted external to the print head. The internal shuttering component can be actuated electromechanically or pneumatically, and is used to further decrease shuttering times.

Extended Sheath Flow

In some cases, it may be necessary to extend the combined sheath/aerosol flow distance so that flow disturbances in the sheath gas are dampened or completely eliminated before the combined flow passes through lens 1. The extended combined flow helps to ensure that a cylindrically symmetric pressure distribution is obtained before the flow enters lens 1.

Multi-Nozzle Microjet Arrays

The general design of invention is applicable to the manufacture of multi-nozzle arrays. In a multi-nozzle configuration, an assembly consisting of several exit nozzles with sheathed flows is fabricated—usually in a linear array—so that simultaneous deposition from each nozzle is enabled.

Laser-Assisted Microjet Deposition

In another embodiment the apparatus is configured so that the aerosol stream is intercepted at the substrate by a focused laser beam. The laser energy provides heating of the aerosol stream. The configuration allows for deposition of features with line widths less than 10 microns. The laser-jet configuration allows for controlled heating and evaporation of the deposited liquid while minimizing heating of a transparent, nearly transparent, or opaque substrate. In some cases, uncontrolled spreading of the aerosol will occur as the stream strikes the substrate. Increasing the viscosity of the liquid just above the deposition zone changes the fluid dynamics so that uncontrolled spreading and even splashing is eliminated. Laser heating of the aerosol just before or just after impact onto the substrate increases the viscosity of the ink. The increased viscosity allows for deposition of structures with increased line height, and also enables printing of three-dimensional structures. The line height is then dependent on the incident laser power, the aerosol deposition rate, and the substrate speed.

Direct Printing of UV Curable Inks

In one embodiment of the invention, the aerosol is formed from a UV curable ink. Focused or unfocused UV or visible laser radiation is directed onto the aerosol stream so that in-flight curing of the ink is accomplished. The laser radiation may also be focused onto the substrate deposition zone to promote real time curing of the deposited ink.

3D Printing

The present invention can also be used to build three-dimensional structures using a layer-wise process, wherein simple and complex objects are printed directly from a computer-automated drawing (CAD) file. In the 3D printing process, laser-assisted deposition is used to deposit material with a viscosity sufficient to form a rigid or semi-rigid structure upon which subsequent layers are deposited. In the 3D printing technique, a digital model of an object is intersected with horizontal planes. The horizontal planes form cross sectional representations or slices of the object. Information in each slice is uploaded to a computerized motion control system, so that a solid object can be fabricated using an additive manufacturing process. The process can be used to fabricate three-dimensional objects from materials including, but not limited to metals, ceramics, and plastics.

3-D Structures for Medical Applications

In yet another embodiment the apparatus of the invention could be used to produce structures for medical applications. The technology could be used to produce scaffolding for tissue engineering applications. A similar apparatus could be used to print living cells and nutrients for those cells in tissue engineering applications.

The invention claimed is:

1. An apparatus for non-contact shuttering of an aerosol stream, the apparatus comprising;

a print head comprising an atomization source, a cold plate, an interchangeable ink cartridge with an attached ink vial, a flow cell comprising an aerodynamic lens system consisting of at least one aerodynamic lens and one converging fluid dispense nozzle;

a sheath gas flow propagating through both the aerodynamic lens system and the fluid dispense nozzle;

a non-contact pneumatic shuttering valve assembly operated external to the print head.

2. The apparatus of claim 1 wherein shuttering of an aerosol stream occurs with no impaction or diversion of the aerosol stream exterior to the print head.

3. The apparatus of claim 1 wherein the shuttering assembly includes a single three-way valve that directs an aerosol carrier gas flow to an aerosol chamber during printing, and redirects and combines the aerosol carrier gas flow with a sheath gas flow during shuttering.

4. The apparatus of claim 1 wherein multiple valves are used to redirect and combine the aerosol carrier gas flow with a sheath gas flow during shuttering.

5. The apparatus of claim 1 wherein the internal pressure of the print head during printing is held equal to the internal pressure of the print head during shuttering.

6. The apparatus of claim 1 wherein shuttering times as fast as 10 milliseconds are achieved.

7. The apparatus of claim 1 with a minimum unassisted print duration of eight hours.

8. The apparatus of claim 1 wherein the aerosolization source is an ultrasonic atomizer with a frequency between 1.0 and 1.4 MHz.

9. The apparatus of claim 1 wherein a single solenoid valve or multiple solenoid valves exterior to the print head divert an aerosol stream from the internal print head flow axis and through a vacuum exhaust port.

10. The apparatus of claim 1 wherein compression and vacuum shuttering flows propagate perpendicular to a combined aerosol/sheath flow and through an exhaust valve, producing shuttering of an aerosol stream within the print head.

11. An apparatus for shuttering of an aerosol stream, the apparatus comprising;

a print head comprising an atomization source, a cold plate, an interchangeable ink cartridge with an attached ink vial, a flow cell comprising an aerodynamic lens system consisting of at least one aerodynamic lens and one converging fluid dispense nozzle;

a sheath gas flow propagating through both the aerodynamic lens system and the fluid dispense nozzle;

an assembly for shuttering an aerosol stream internal to the print head using a mechanical shutter;

a pneumatic shuttering valve assembly operated external to the print head.

12. The apparatus of claim 11 wherein a shuttering component such as an internal plunger or flap is used to block flow of an aerosol stream into the flow cell of the print head while an aerosol gas flow is diverted and combined with a sheath gas flow using an external shuttering valve assembly.

* * * * *